US006274833B1

(12) United States Patent
Moody

(10) Patent No.: US 6,274,833 B1
(45) Date of Patent: Aug. 14, 2001

(54) PLUG-IN TRIP UNIT JOINT FOR A MOLDED CASE CIRCUIT BREAKER

(75) Inventor: G. Lawrence Moody, Cumming, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/507,144

(22) Filed: Feb. 18, 2000

(51) Int. Cl.[7] ..... H01H 23/00

(52) U.S. Cl. ..... 200/401; 335/35

(58) Field of Search ..... 200/401; 335/23–25, 335/167–176, 16, 147, 195; 218/22

(56) References Cited

U.S. PATENT DOCUMENTS

| | | | | |
|---|---|---|---|---|
| 3,815,509 | * | 6/1974 | Spoelman | 335/16 |
| 4,550,300 | * | 10/1985 | Jencks et al. | 335/16 |
| 4,563,557 | * | 1/1986 | Leone | 200/288 |
| 4,958,136 | * | 9/1990 | Maier et al. | 335/42 |
| 5,258,733 | * | 11/1993 | Link et al. | 335/172 |
| 5,319,169 | * | 6/1994 | Link et al. | 200/401 |
| 5,341,191 | * | 8/1994 | Crookston et al. | 335/16 |
| 5,791,458 | | 8/1998 | DiMarco et al. | 200/401 |
| 5,872,495 | * | 3/1999 | DiMarco et al. | 335/35 |
| 5,926,081 | * | 7/1999 | Dimarco et al. | 335/16 |
| 5,994,988 | * | 11/1999 | Ferree et al. | 335/190 |
| 6,084,188 | * | 7/2000 | Mueller et al. | 200/305 |

* cited by examiner

*Primary Examiner*—Paula Bradley
*Assistant Examiner*—Nhung Nguyen

(57) ABSTRACT

A plug-in trip unit joint 900 for a molded case circuit breaker 10, with the circuit breaker 10 having an operating mechanism 40 with a movable contact arm 45 mounted on a cross-bar 55, a trip bar 618 and a line terminal mounted in a first housing and a trip unit 600 and a load terminal 16 mounted in a second housing. The plug-in trip unit joint 900 comprises a trip unit stab 910 coupled to the trip unit 600 and load terminal 16 and extends from the second housing and a movable contact arm clamp assembly 909 mounted in the first housing and aligned to selectively engage the trip unit stab 910 wherein the line terminal 18 and the load terminal 16 are electrically coupled together and with the trip unit in selective contact with the operating mechanism 40 of the circuit breaker 10. The movable contact arm clamp assembly 909 comprises a pair of connectors 916, 918 with one connector 916 positioned along one side of the movable contact arm 45 and one connector 918 positioned on a corresponding opposite side of the movable contact arm 45. Each connector 916, 918 has a first end 930 and a second end 932 with the first end 930 configured to engage one side of the movable contact arm 45 and the second end 932 configured to engage one side of the trip unit stab 910. A biasing member 920 positioned to engage both connectors between the first and second ends 930, 932 of each connector 916 is installed to urge both connectors 916, 918 against the movable contact arm 45 and the trip unit stab 910 and establishes an electrical and mechanical coupling. The contactors sandwich the contact arm 45 and the trip unit stab 910 between them and is held together with a U-shaped spring. In one embodiment, each end of the connector 916 includes a spherical surface for engagement with the movable contact arm 45 and the trip unit stab 910.

13 Claims, 6 Drawing Sheets

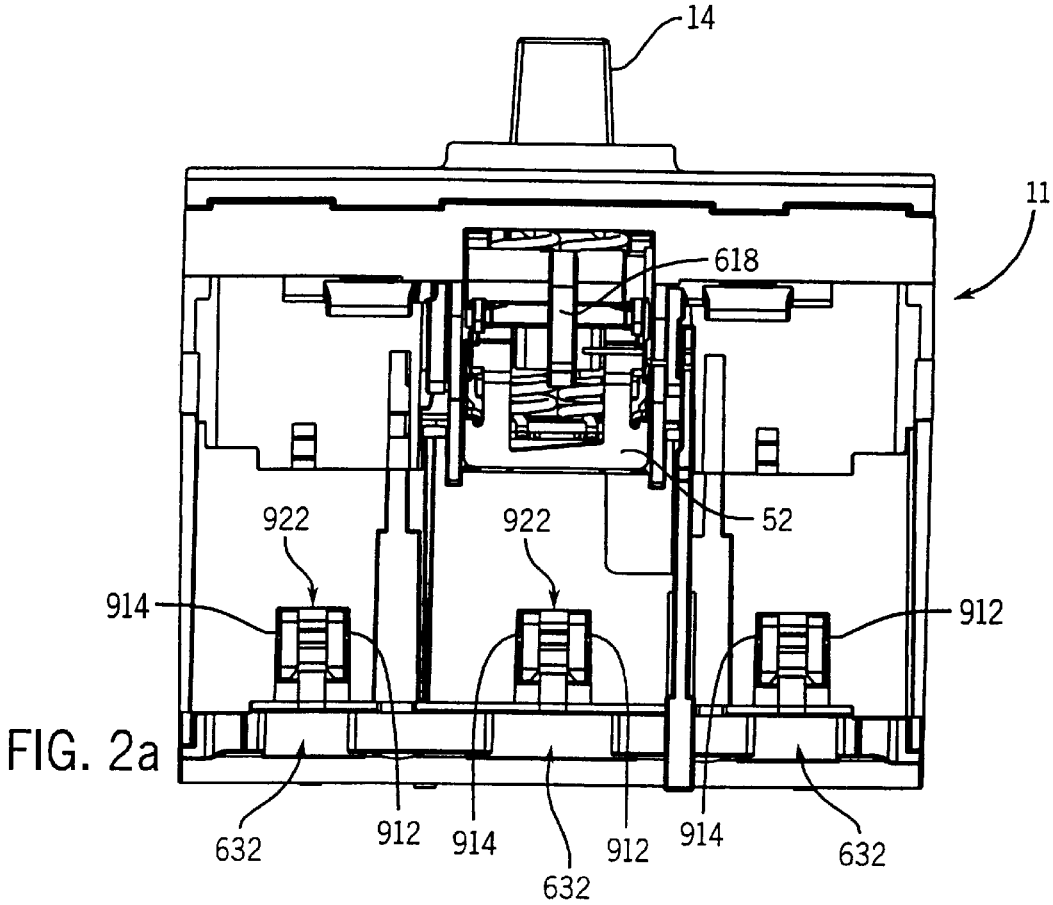
FIG. 2a
FIG. 2
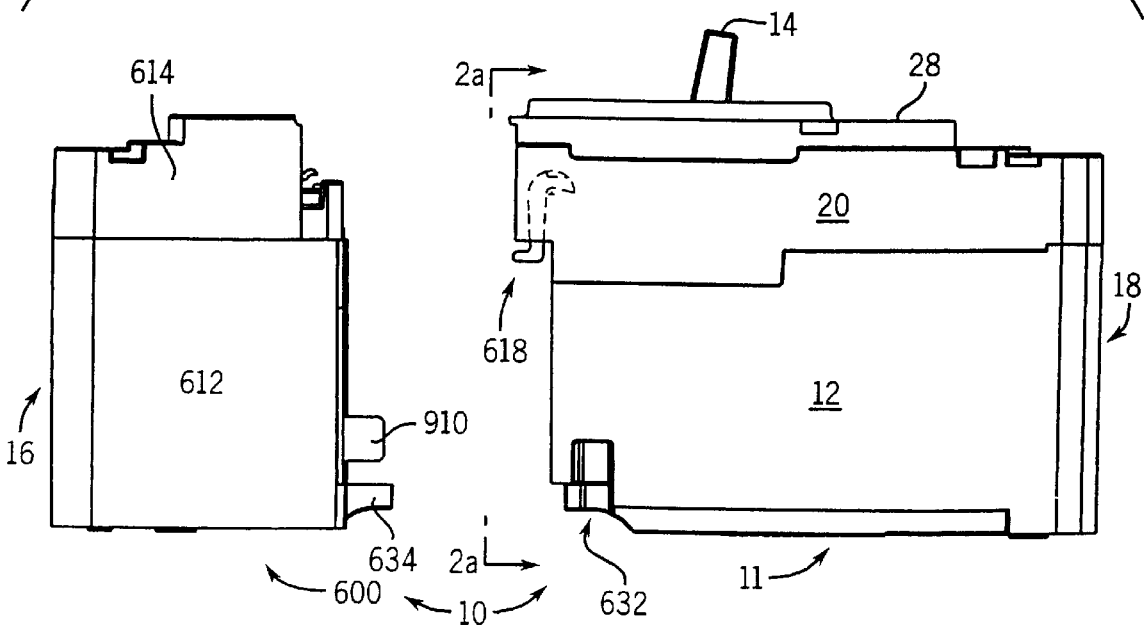

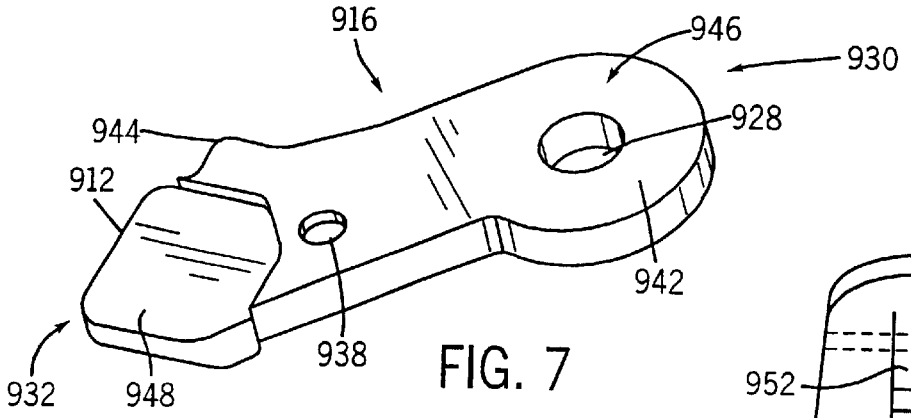
FIG. 7
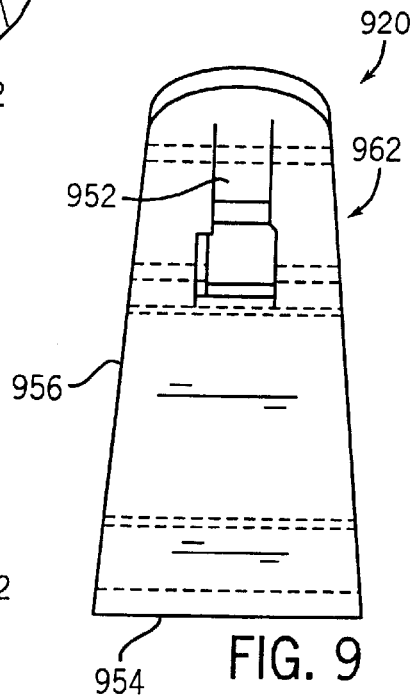
FIG. 9
FIG. 8
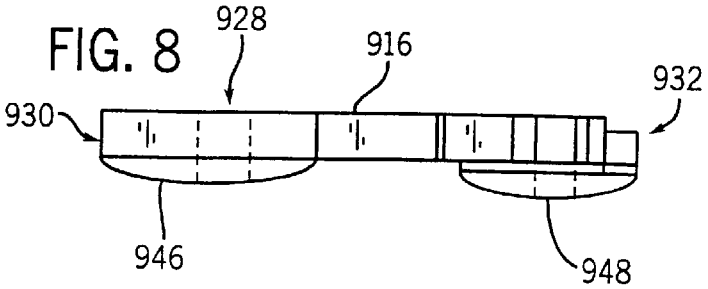
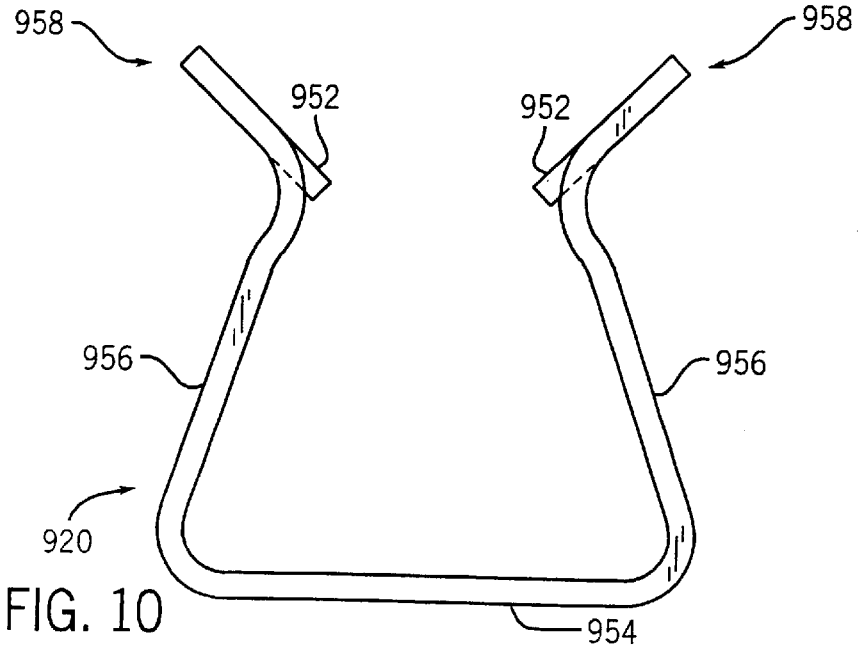
FIG. 10

PLUG-IN TRIP UNIT JOINT FOR A MOLDED CASE CIRCUIT BREAKER

FIELD OF THE INVENTION

The present invention relates generally to the field of circuit breakers, and more particularly to a plug-in trip unit joint for a molded case circuit breaker.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as several thousand amps. The tripping mechanism for the breaker usually consists of a thermal overload release and a magnetic short circuit release. The thermal overload release operates by means of a bi-metalic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that that current is flowing. For a given range of current ratings, the bi-metal cross-section and related elements are specifically selected for such current range resulting in a number of different circuit breakers for each current range. Electronic trip units are also used in some applications.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker. Again, electronic trip units can also be used.

It is well known in the art that a trip unit for a circuit breaker can be what is referred to as a plug-in unit. Typically, the plug-in trip unit contains the thermal magnetic trip mechanism or the electronic trip mechanism electrically coupled to the load terminals for the circuit breaker. The plug-in trip unit is coupled to the frame portion of the circuit breaker. The frame portion of the circuit breaker typically contains the line terminals, the contact arms, the operating mechanism and the handle of the circuit breaker. The frame portion of the circuit breaker may also contain accessories that work in conjunction with the circuit breaker for various applications. The connection between the plug-in trip unit and the circuit breaker frame unit typically are bolted/tab connections or flexible braid connections. However, those types of connections are relatively expensive to manufacture and assemble, therefore manufacturing is relatively time consuming. Another approach to the connection between the plug-in trip unit and the breaker frame unit is to provide a blade that is slidingly engageable with a jaw to permit electrical engagement and disengagement between the trip unit and the frame unit. However, this arrangement creates significant problems of tolerances in trying to maintain good electrical contact between the contact arm, the connectors and the trip unit stabs. Each part in the assembly is subject to manufacturing tolerances that cause variation in the positions of the parts. In multi-pole circuit breakers such tolerance problems are multiplied by the number of poles in the circuit breaker. Another problem encountered in the blade and jaw arrangement is that the flat mating surfaces can cause excessively high and variable resistances in the joint as well as concentrating a high fault current in a relatively small area thereby causing current constriction forces which tend to blow the joint apart and cause undesireable arcing in the joint. Additional problems with such an arrangement include excessive friction which can result in either an inhibited ability to plug in the trip unit or inhibit the rotation of the contact arms.

Thus, there is a need for a molded case circuit breaker that provides a plug-in trip unit joint that facilitates an easy connection and disconnection of the trip unit from the circuit breaker frame unit. There is a further need for a plug-in trip unit joint that reduces or eliminates positional and angular misalignment between the contact arms and the trip unit while maintaining the functional quality of the electrical interface. There is an additional need to provide a plug-in trip unit joint that minimizes frictional torque on the movable contact arm of the circuit breaker and to not excessively concentrate the electrical current in the joint.

SUMMARY OF THE INVENTION

The present invention provides a plug-in trip unit joint for a molded case circuit breaker, with the circuit breaker having an operating mechanism with a movable contact arm mounted on a cross-bar, a trip bar and a line terminal mounted in a first housing and a trip unit and a load terminal mounted in a second housing. The plug-in trip unit joint comprises a trip unit stab coupled to the trip unit and load terminal and extends from the second housing and a movable contact arm clamp assembly mounted in the first housing and aligned to selectively engage the trip unit stab wherein the line terminal and the load terminal are electrically coupled together and with the trip unit in selective contact with the operating mechanism of the circuit breaker. The movable contact arm clamp assembly comprises a pair of connectors with one connector positioned along one side of the movable contact arm and one connector positioned on a corresponding opposite side of the movable contact arm. Each connector has a first end and a second end with the first end configured to engage one side of the movable contact arm and the second end configured to engage one side of the trip unit stab. A biasing member positioned to engage both connectors between the first and second ends of each connector is installed to urge both connectors against the movable contact arm and the trip unit stab and establishes an electrical and mechanical coupling. The contactors sandwich the contact arm and the trip unit stab between them and is held together with a U-shaped spring. In one embodiment, each end of the connector includes a spherical surface for engagement with the movable contact arm and the trip unit stab. In another embodiment, the movable contact arm in the trip unit stab is provided with a spherical surface for engagement with each connector. In an additional embodiment, the movable contact arm slidingly mounts a pivot pin in a slot with the pivot pin secured in the cross bar of the operating mechanism with the pivot pin and crossbar aligned on a common axis.

The present invention also provides a molded case circuit breaker comprising a first molded housing including a breaker cover, a first terminal mounted in the first housing with a contact electrically coupled to the first terminal. An operating mechanism mounted in the first housing has a pivoting member movable between an ON position, an OFF position and a TRIPPED position and a movable contact arm coupled to the operating mechanism. An intermediate latching mechanism is also mounted in the first housing and is coupled to the operating mechanism. The circuit breaker also includes a second housing and a second breaker cover with the trip mechanism and a second terminal mounted in the second housing with the first housing and second housing connected by a plug-in trip unit joint comprising a trip unit stab coupled to the trip unit and load terminal and extending from the second housing and a movable contact arm clamp assembly mounted in the first housing and aligned to selectively engage the trip unit stab wherein the line terminal and the load terminal are electrically coupled together and the trip unit is in selective contact with the operating mechanism. The movable contact arm clamp assembly comprises a pair of connectors with one connector positioned alongside the movable contact arm and one connector positioned on a corresponding opposite side of the movable contact arm. Each connector has a first end and a second end with the first end configured to engage one side of the movable contact arm and the second end configured to engage one side of the trip unit stab. A biasing member positioned to engage both connectors between the first and second end of each connector sandwiches the movable contact arm and the trip unit stab between the two connectors with the biasing member urging both connectors against the movable contact arm and the trip unit stab. Such urging establishes an electrical and mechanical coupling between the various parts. One embodiment of the present invention includes a biasing member that is U-shaped having a lance on each leg with the lance configured to engage a detent in each connector. Another embodiment of the present invention provides each end of the connector with a spherical surface for engagement with the movable contact arm and the trip unit stab. A further embodiment of the present molded case circuit breaker provides for the movable contact arm and trip unit stab having a spherical surface for engagement with each connector.

BRIEF DESCRIPTION OF THE DRAWINGS

FIG. 2 is a plan side view of an exemplary embodiment of the molded case circuit breaker illustrating the separate trip unit and the breaker frame portion.

FIG. 2*a* is an end plan view of the frame portion of the circuit breaker in FIG. 2 illustrating the movable contact arm clamp assembly and the trip bar.

FIG. 7 is an isometric drawing of an example of a connector for the plug-in trip unit joint illustrated in FIG. 5.

FIG. 8 is a top plan view of the connector illustrated in FIG. 7.

FIG. 9 is a side view of a U-shaped spring type biasing member of the movable contact arm clamp assembly for the plug-in trip unit joint illustrated in FIG. 5.

FIG. 10 is a front view of the biasing member illustrated in FIG. 9.

DETAILED DESCRIPTION OF THE PREFERRED EMBODIMENTS

Figure 1:
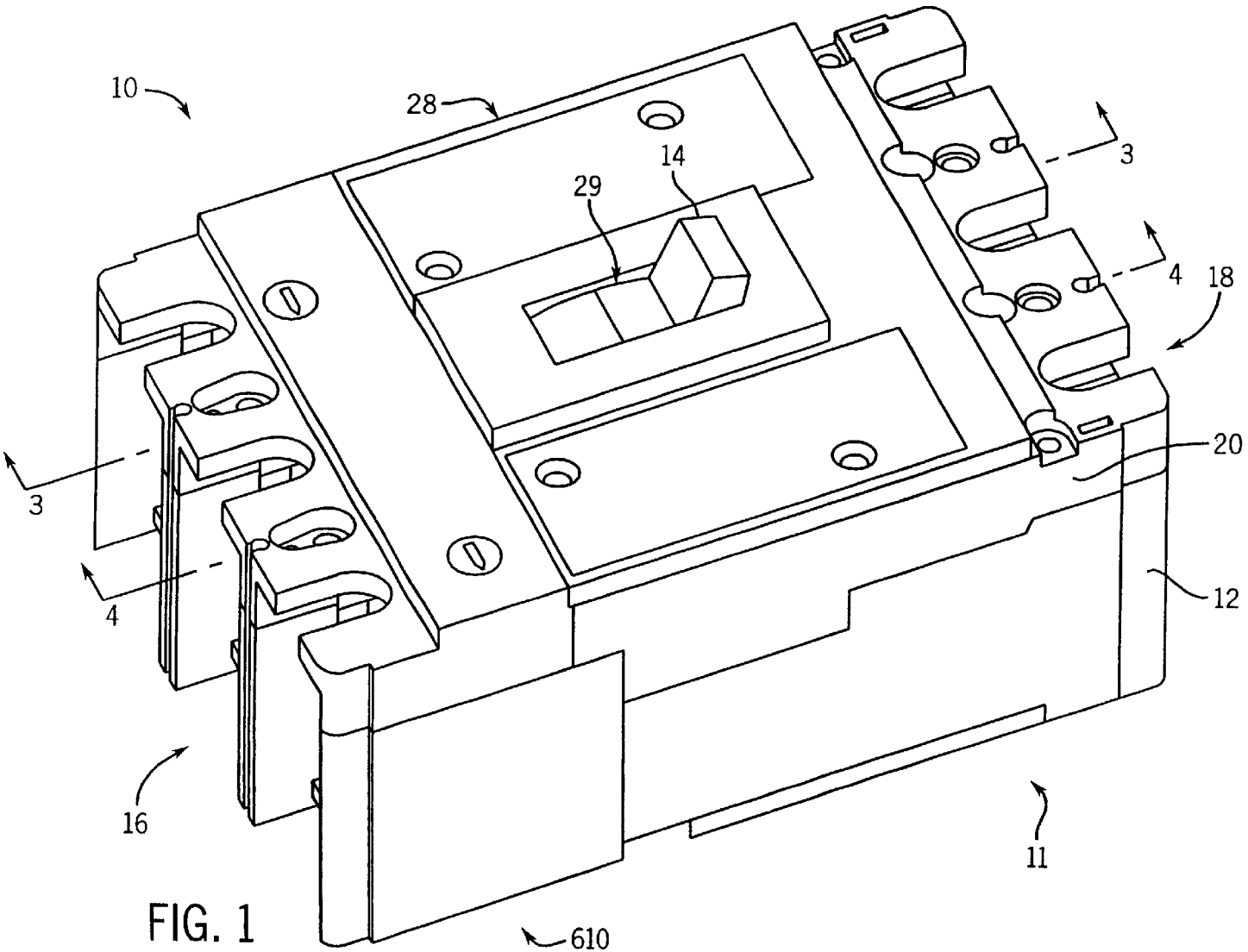
FIG. 1 is an isometric drawing of a molded case circuit breaker which includes an exemplary embodiment of the plug-in trip unit joint.

FIG. 1 generally illustrates a three phase molded case circuit breaker 10 of the type which includes an operating mechanism 40 having a pivoting member 13 with a handle 14. The pivoting member 13 and handle 14 are movable between an ON position, an OFF position and a TRIPPED position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Referring to FIG. 2, the circuit breaker 10 has a trip unit portion 600 and a frame portion 11. The trip unit portion 600 engages the frame portion 11 with a trip unit projection 634 that couples into a breaker frame recess 632. In the preferred embodiment of the trip unit 600, the projection 634 is a dove tail shaped projection that engages a corresponding dove tailed recess of the breaker frame recess 632. In the preferred embodiment there are plurality of breaker frame recesses 632 and trip unit projection 634 as best seen in FIG. 2*a*. The trip unit 600 includes a trip unit housing 612 with a separate trip unit cover 614. Mounted in the trip unit housing 612 is the load terminal 16 and the tripping sensors, (such as thermal, magnetic or electronic), which are coupled to a trip unit stab 910. The frame portion 11 of the circuit breaker 10 includes a housing 12 with a breaker cover 20 which houses the operating mechanism 40, line terminal 18, movable contact arm 45, handle 14 and related components which will be discussed below. In operation, the trip unit 600 is mated with the frame portion 11 of the circuit breaker 10 by engaging the breaker frame recess 632 with the trip unit projection 634 to provide a mechanical coupling of the two portions. The trip unit stab 910 engages a movable arm contact clamp assembly 909 and forms a plug-in trip unit joint 900 as will be described below. The trip unit 600 also is aligned to selectively contact the trip bar 618 in the frame portion 11 of the circuit breaker 10.

Figure 3:
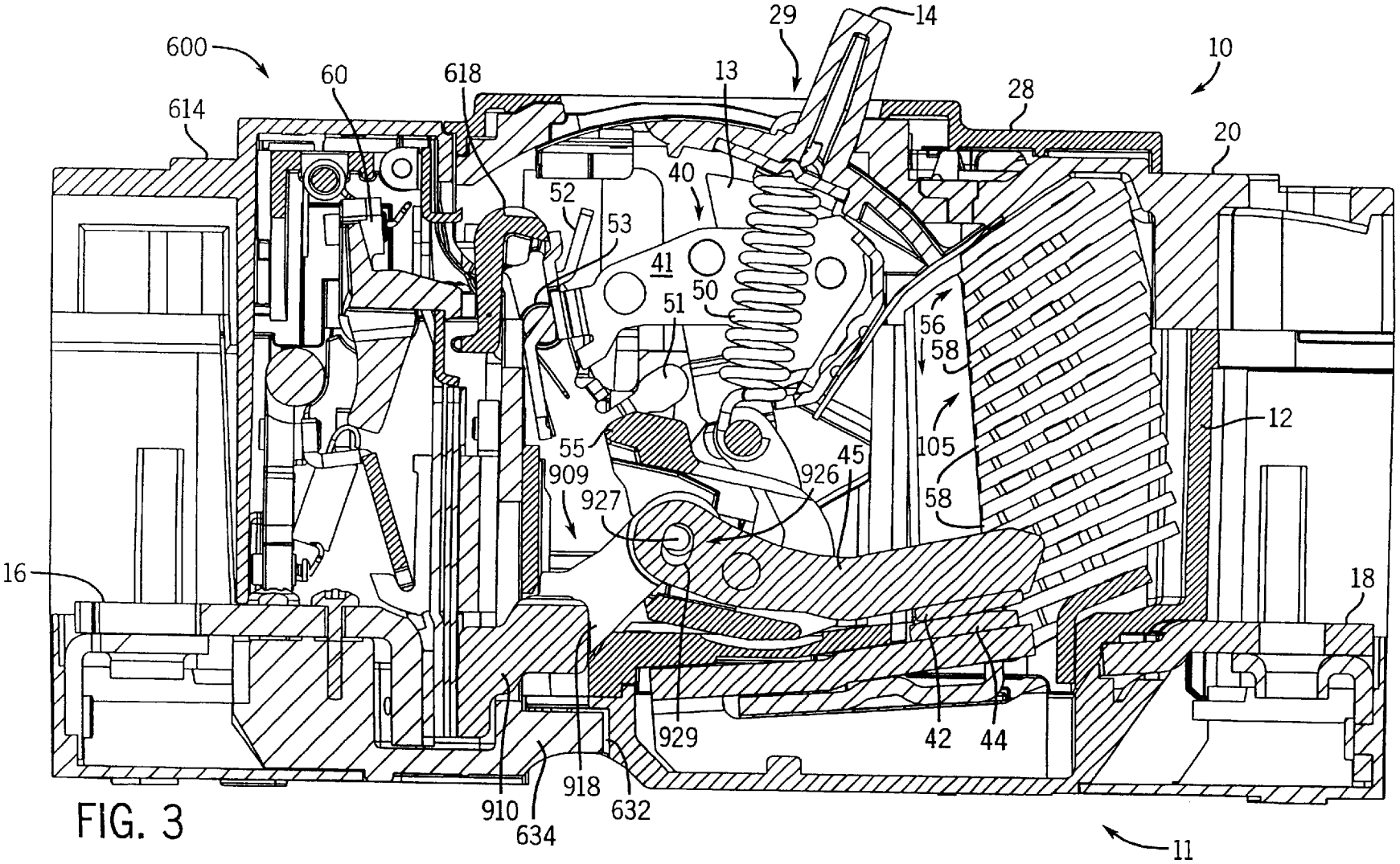
FIG. 3 is a section view of the circuit breaker shown in FIG. 1 along the lines 3–3 illustrating an example of the plug-in trip unit joint connecting the frame portion and trip unit of the circuit breaker, with the circuit breaker in the ON position.

Referring to FIG. 3, handle 14 is operable between the ON and OFF positions to enable a contact operating mechanism 40 to engage and disengage a movable contact 42 and a stationary contact 44 for each breaker pole, such that the line terminal 18 and load terminal 16 of each phase can be electrically connected. The circuit breaker housing 12 includes three portions which are molded from an insulating material. These portions include a circuit breaker base, a sub-base, a main circuit breaker cover 20 and an accessory cover 28, with the main breaker cover 20 and the accessory cover 28 having an opening 29 for the handle 14 of the pivoting member 13. The pivoting member 13 and handle 14 move within the opening 29 during the several operations of the circuit breaker 10. FIG. 3 is a cut away view of the circuit breaker 10 along the lines 3–3 shown in FIG. 3. As shown in FIG. 3, the main components of the frame portion 11 of the circuit breaker 10 are a fixed line contact arm and a movable load contact arm 45. It should be noted that another embodiment of the circuit breaker 10 has a movable line contact arm to facilitate a faster current interruption action. The load contact arms for each of the three poles of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms thereby making electrical contact between moveable contact pad 42 and stationary contact pad 44. The trip unit 600, in FIG. 3 is of the thermal-magnetic type. It should be understood that the trip unit 600 can also be an electronic trip unit type.

Figure 4:
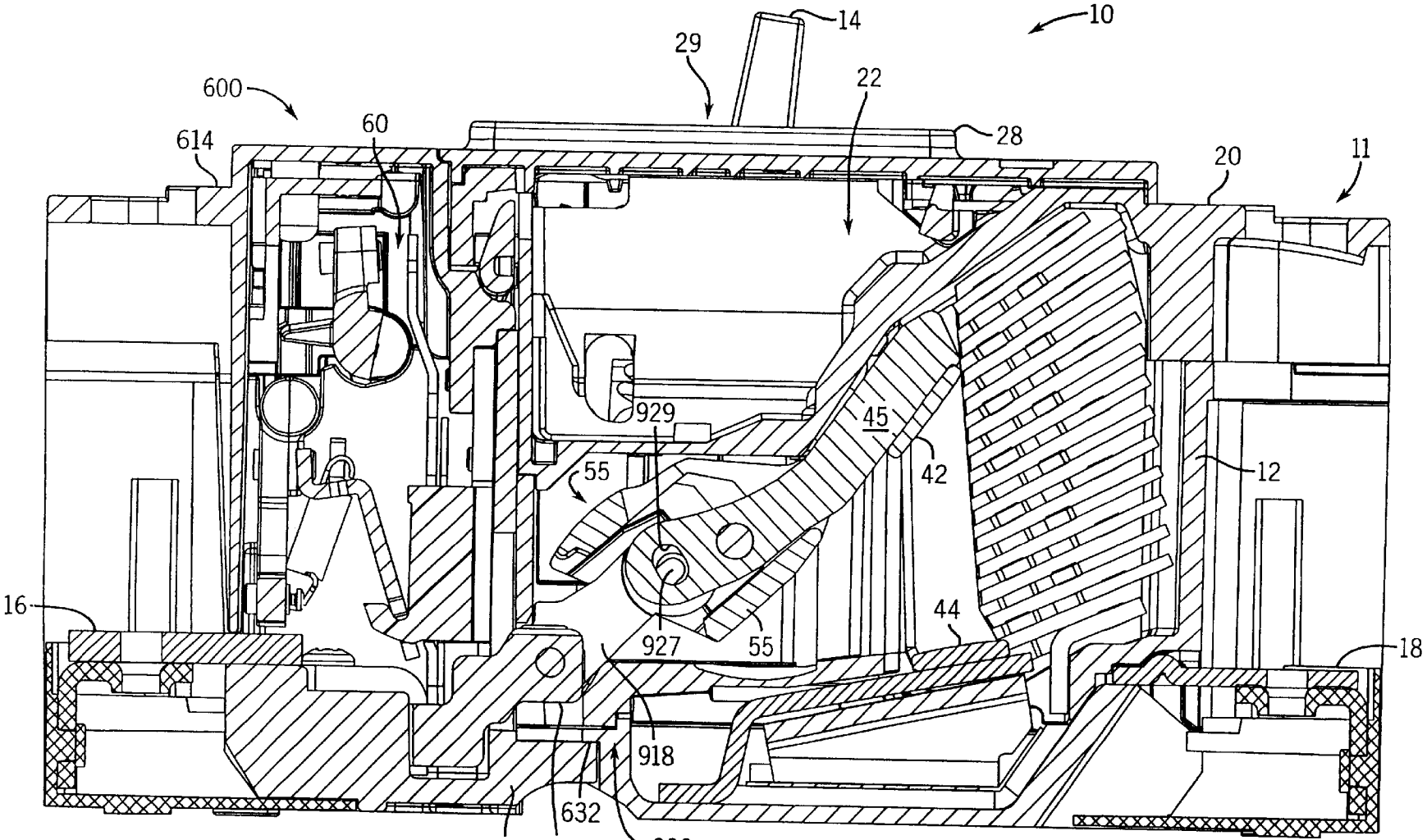
FIG. 4 is a sectional view of the circuit breaker shown in FIG. 1 along the lines 4–4 illustrating an example of the plug-in trip unit connecting the frame portion and the trip unit of the circuit breaker, with the circuit breaker in the TRIPPED position.

Referring to FIGS. 3 and 4, the operating mechanism 40 includes a cradle 41 which engages an intermediate latch 52 to hold the contacts of the circuit breaker in a closed position unless and until an over current condition occurs, which causes the circuit breaker to trip. A portion of the movable contact arm 45 and the stationary contact bus are contained in an arc chamber 56. Each pole of the circuit breaker 10 is provided with an arc chamber 56 which is molded from an insulating material and is part of the circuit breaker 10 housing 12. A plurality of arc plates 58 are maintained in the arc chamber 56. The arc plates facilitate the extension and cooling of the arc formed when the circuit breaker 10 is opened while under a load and drawing current. The arc chamber 56 and arc plates 58 direct the arc away from the contact pads 42, 44.

The exemplary intermediate latch 52 is generally Z-shaped having one leg which includes a latch surface that engages the cradle 41 and another leg having a latch surface which engages a trip bar 618. The center portion of the Z-shaped intermediate latch element 52 is angled with respect to the two legs and includes two tabs which provide a pivot edge for the intermediate latch 52 when it is inserted into the mechanical frame 51. The intermediate latch 52 is typically coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 618 into a position which engages the lower latch surface of the intermediate latch 52. The trip bar 618 pivots in a counter clockwise direction about an axis, responsive to a force exerted by a trip mechanism 60, during, for example, a long duration over current condition. As the trip bar 618 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact 44.

During normal operation of the circuit breaker, current flows from the line terminal 18 through the line contact arm and its stationary contact pad 44 to the load contact arm 45 through its contact pad 42.

From the load contact arm 45, the current flows through a coupler, such as a flexible braid, plug-in trip unit joint 900 or other suitable and convenient connection, to the trip mechanism 60 and from the trip mechanism 60 to the load terminal 16. When the current flowing through the circuit breaker exceeds the rated current for the breaker, the trip mechanism 60 engages the trip bar 618. As the trip mechanism engages the trip bar surface and continues to bend, it causes the trip bar 618 to rotate in a counter clockwise direction releasing the intermediate latch 52 and thus unlatching the operating mechanism 40 of the circuit breaker.

The load contact arm 45 as well as the contact arms for the other poles, are fixed in position on the cross bar element 55. As mentioned above, additional poles, such as a four pole molded case circuit breaker can utilize the same construction as described herein, with the fourth pole allocated to a neutral. The load contact arm 45 is coupled to the trip mechanism 60 by a conductor (e.g. braided copper strand or plug-in trip unit joint). Current flows from the conductor through the trip mechanism 60 to a connection which couples the current to the load terminal 16 through a load bus. The load bus is supported by a load bus support mounted in the housing 612.

In the exemplary circuit breaker 10, the cross bar 55 is coupled to the operating mechanism 40, which is held in place in the base or housing 12 of the molded case circuit breaker 10 by a mechanical frame. The key element of the operating mechanism 40 is the cradle 41. The cradle 41 includes a latch surface which engages the upper latch surface in the intermediate latch 52. The intermediate latch 52 is held in place by its mounting tabs which extend through the respective openings on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

The breaker cover 20, in the preferred embodiment, has two accessory sockets 22 formed in the cover 20, with one accessory socket on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The breaker cover 20 is sized to cover the operating mechanism 40, the moveable contact 42 and the stationary contact 44. The breaker cover has an opening 29 to accommodate the handle 14. The circuit breaker 10 provides a separate housing 612 for the trip mechanism 60 and load terminal 16 and a cover 614. Each accessory socket 22 or compartment is provided with a plurality of openings. The accessory socket openings are positioned in the socket to facilitate coupling of an accessory with the operating mechanism 40 mounted in the housing 12. The accessory socket openings also facilitate simultaneous coupling of an accessory with different parts of the operating mechanism. Various accessories can be mounted in the accessory compartment to perform various functions. Some accessories, such as a shunt trip, will trip the circuit breaker 10, upon receiving a remote signal, by pushing the trip bar 618 in a counter clockwise direction causing release of the mechanism latch 52 of the operating mechanism 40. Another accessory, such as an auxiliary switch, provides a signal indicating the status of the circuit breaker 10, e.g. "on" or "off". Multiple switches can be nested in one accessory socket and each switch can engage the operating mechanism through an opening in the socket.

Figure 5:
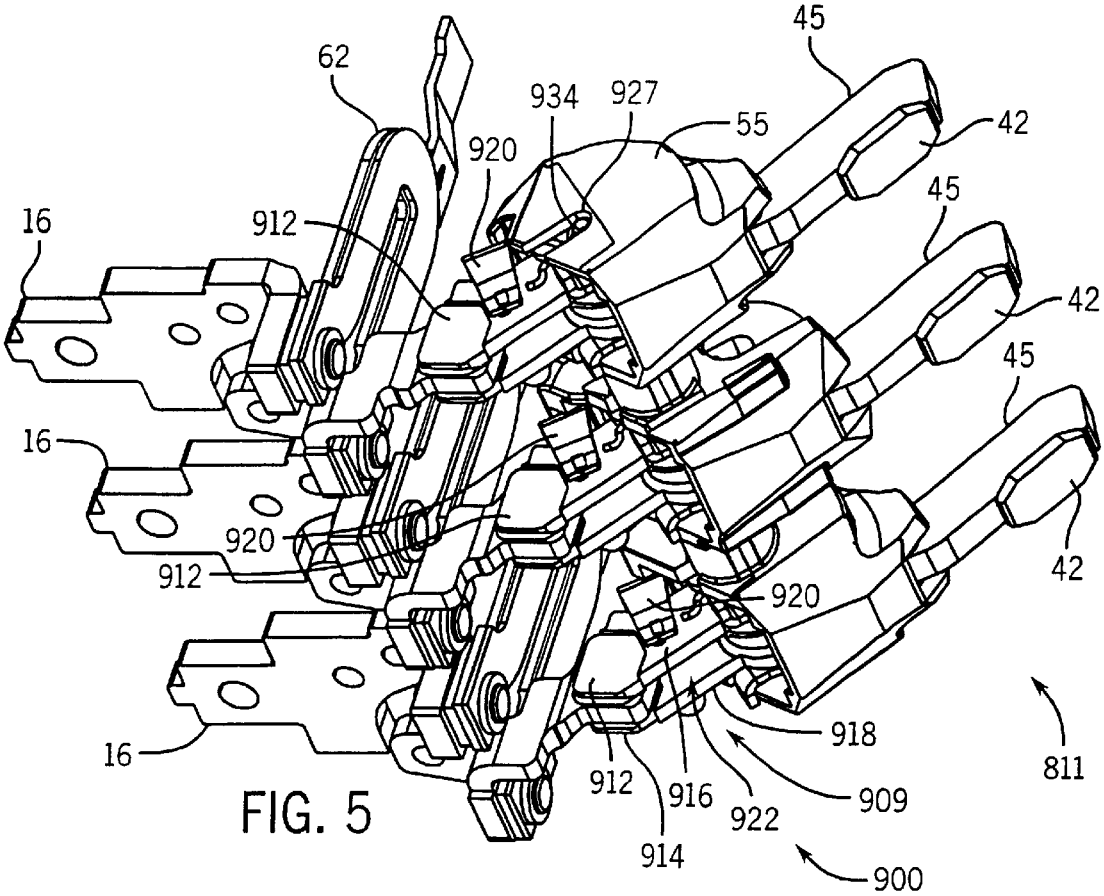
FIG. 5 is an isometric drawing of an example of a movable contact arm and crossbar assembly of the circuit breaker connected to a portion of the trip unit illustrating an example of a plug-in trip unit joint.
Figure 6:
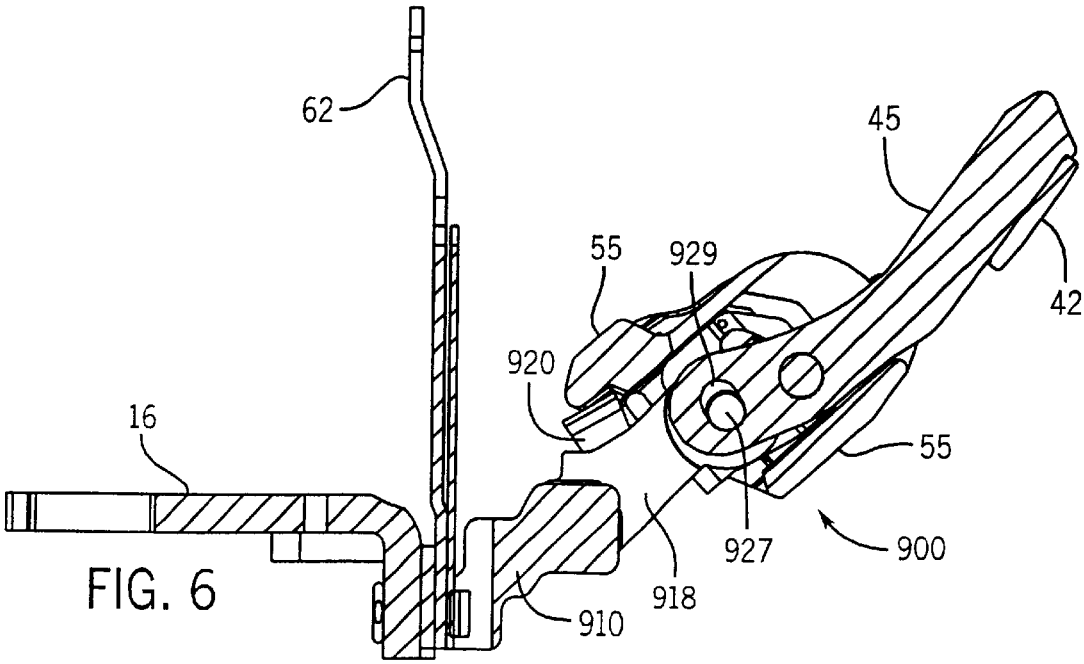
FIG. 6 is a sectional side view of the plug-in trip unit joint illustrated in FIG. 5 along the center line of one of the contact arms and load terminals.

FIGS. 5 and 6 illustrate a moving contact with a plug-in trip unit joint 900 crossbar assembly 811 for a molded case circuit breaker. The crossbar 55 is pivotally mounted in the housing 12. The crossbar pivots along a horizontal axis that is coincident with a pivot pin 927 for the movable contact arm 45. FIGS. 5 and 6 illustrate a multi-pole moving contact and crossbar assembly. It should be understood that the moving contact and bar assembly can also be used in a single pole circuit breaker or in a four pole circuit breaker with the fourth pole being designated a "neutral." The crossbar 55 and movable contact arm 45 are coupled to the load terminal 16 through the plug-in trip unit joint 900 and the trip mechanism 60. The trip mechanism 60 is housed in a separate housing and mechanically and electrically connected to the circuit breaker housing 12.

Referring to FIGS. 5 and 6, the movable contact arm 45 and crossbar 55 assembly coupled to the bi-metal 62 trip unit is shown in an isolated, isometric view. The contact arms 45 of the multiple-pole circuit breaker is shown in the TRIPPED condition is also shown in FIG. 4. The plug-in trip unit joint 900 comprises a trip unit stab 910 coupled to the trip unit 600 and a movable contact arm clamp assembly 909 aligned and selectively engaged to the trip unit stab 910. The movable contact arm clamp assembly 909 comprises a pair of connectors 916, 918 with one connector 916 positioned along side of the movable contact arm 45 and one connector 918 positioned on a corresponding opposite side of the movable contact arm 45 with each connector 916, 918 having a first end 930 and a second end 932 with the first end 930 configured to engage one side of the movable contact arm 45 and the second end 932 configured to engage one side of the trip unit stab 910. The connectors 916, 918 are held in position by a biasing member 920 positioned to engage both connectors 916, 918 between the first and second ends, 930, 932 of each connector.

The biasing member 920 urges both connectors 916, 918 against the movable contact arm 45 and the trip unit stab 910 and establishes an electrical and mechanical coupling. Such arrangement establishes a pivoting electrical joint. The trip unit stab 910 is able to slide in between the two connectors 916, 918 to establish an electrical connection to the trip unit 600. The biasing member 920 provides a clamping force that pushes the two connectors 916, 918 together and sandwiches the contact arm 45 and the stab 910 between them. The biasing member 920 applies the clamping force approximately halfway between the two ends 930, 932 of the connectors 916, 918 so that the clamping force is about equally divided between the two ends of the connectors. For example, if the biasing member provides about 10 pounds of force in the middle of each connector, then one end of the connector pushes on the contact arm with about 5 pounds of force and pushes on the trip unit stab with about 5 pounds of force also.

The contact arm 45 is provided with a slot 929 which engages a pivot pin 927 to form a pivot 926 around which the contact arm 45 moves during a tripping operation. The elongated slot 929 also aids in prying apart small welded spots on the main contact faces 42, 44. The pivot pin 927 extends through the slot 929 in the contact arm 45 and is held in place by slots 934 in the crossbar 55. The pivot pin 927 is coincident with the crossbar 55 pivot axis such that the crossbar 55 and each movable contact arm 45 rotates about a common axis. The end of the slot 929 is concentric with the axis of rotation of the crossbar 55 so that the axis of the pivot pin 927 is aligned with the axis of the crossbar 55. The slot in the crossbar 55 fixes the pivot pin 927 in all directions except in the direction of the open end of the slot 934. In order to prevent the pivot pin 927 from falling out of the slot 934 in the crossbar 55, the connectors 916, 918 have a stop feature shaped on the second end 932 of each connector that pushes against the wall in the circuit breaker frame base housing 11.

The contact arm 45, connectors 916, 918 and the trip unit stab 910 are all made of an electrical conducting material such as copper. The preferred embodiment of the biasing member 920 is stainless steel stamped from a flat sheet metal and formed into a generally U-shape. It should be noted that other materials and configurations of the spring are also conceivable such as a wire spring or spring washers held by a rivet or a screw. It is also contemplated that the spring force can be divided in proportions other than equal and that the forces could be tuned to any proportion by changing the position of the applied biasing member force relative to the two ends 930, 932 of the connectors, 916, 918.

It should be noted that each set of connectors 916, 918 comprises a set of parallel conductors carrying approximately equal current. During high fault current, this causes the two connectors 916, 918 to be magnetically attracted to each other. This attraction helps prevent arcing and helps counteract the opposing blow apart forces at the end of the conductors due to current constriction at the contact points.

Referring to FIGS. 7 and 8, an example of a single connector 916 is illustrated. Each connector has a first end 930 and a second end 932 with the first end having a pivot aperture 928. The pivot pin 927 extends through the aperture 928 at each connector with the movable contact arm 45 sandwiched between the two connectors. The second end of the connector 932 is formed in a jaw 912. The jaw 912 contacts the trip unit stab 910, with the trip unit stab 910 sandwiched between the jaws of each connector. Each connector is provided with a detent 938 that assists in positioning and maintaining the biasing member 920 in position.

To minimize or eliminate positioning problems, and tolerances between the various connecting parts, a spherical contact interface is provided on each connector 916, 918. A spherical radius 946 is provided on the movable contact arm contact surface 942 of the connector and a spherical radius 948 is provided on the jaw 912 of each connector. The spherical shapes allow a significant amount of positional and angular misalignment between the contact arm 45 and the trip unit stabs 910 without affecting the functional quality of the electrical interface. In addition, the spherical surfaces control friction in a predictable manner. In the contact arm pivot 926, the spherical radius 946 concentrates the clamping forces near the pivot pin 927 which minimizes the frictional torque on the contact arm 45. The spherical shapes 946, 948 are relatively large in radius, in order to enlarge the contact area and not excessively concentrate the electrical current to point contact. It should also be understood that it is also contemplated that the spherical shapes can be formed on the trip unit stab 910 or on the contact arm 45 at the electrical interfaces instead of or in addition to being on the connectors 916, 918.

Referring to FIGS. 9 and 10, the biasing member 920 in the preferred embodiment is a U-shaped spring clamp. As mentioned above, the spring clamp is preferably a stainless steel. In the preferred embodiment, the U-shaped spring has a base portion 954 and two leg portions 956. Each leg portion 956 of the spring clamp 920 has a lead-in flare 958 with a leg taper 960, as best seen in FIG. 9, to help control the location of the applied force. The base portion 954 of the U shaped spring clamp thus is wider to manage the stress experienced by the spring clamp 920. Each leg 956 is flared out 958 as an assembly aid to ensure that an assembly worker does not overspread and therefore overstress the spring during assembly. If the biasing member 920 is overstressed or over extended an insufficient clamping force will be applied to the connectors 916, 918 which will cause the plug-in trip unit joint 900 to blow apart during current interruption. If the biasing member 920 is stressed in the opposite direction, the clamping force exerted on the connectors will cause excessive friction and hamper the operation of the movable contact arm 45. During the manufacturing process of the preferred embodiment of the biasing member 920 a lance tab 952 extends inward from the flared ends 958 of the spring 920 is formed during the stamping operation, the tab is cut in each leg 956 of the biasing member 920 and remains unbent when the flared ends 958 are bent causing the tab to extend inward. The lance 952 engages the spring clamp detent 938 stamped or formed in each connector 916, 918. In the preferred embodiment, the detent is punched as illustrated in FIG. 7.

The cover 20 can be configured to cover both housings or the cover 20 can also be in two parts with each part covering a respective separate housing of the circuit breaker 10. Another embodiment of the molded case circuit breaker further comprises an accessory socket formed in the breaker cover 20 on either side of the opening 29 for the pivoting member 13 with the accessory socket in communication with the housing 12 and configured to accept a plurality of different types of accessories. An accessory cover 28 is sized to cover an accessory mounted in the accessory socket.

While the embodiments illustrated in the figures and described above are presently preferred, it should be understood that these embodiments are offered by way of example only. Invention is not intended to be limited to any particular embodiment, but it is intended to extend to various modifications that nevertheless fall within the scope of the intended claims. For example it is also contemplated that the trip mechanism having an interchangeable bi-metal trip unit or an electronic trip unit with a load terminal providing for a quick and easy change of current rating for an application of the circuit breaker contemplated herein. Modifications will be evident to those with ordinary skill in the art.

What is claimed is:

1. A plug-in trip unit joint for a molded case circuit breaker having an operating mechanism with a movable contact arm mounted on a crossbar, a trip bar and a line terminal mounted in a first housing and a trip unit and load terminal mounted in a second housing, the plug-in trip unit joint comprising:

a trip unit stab coupled to the trip unit and load terminal and extending from the second housing; and, a movable contact arm clamp assembly mounted in the first housing and aligned to selectively engage the trip unit stab, the movable contact arm clamp assembly comprises:

a pair of connectors with one connector positioned along side of the movable contact arm and one connector positioned on a corresponding opposite side of the movable contact arm, with each connector having a first end and a second end, with the first end configured to engage one side of the movable contact arm and the second end configured to engage one side of the trip unit stab; and, a U-shaped spring, having a lance in each leg, with the lance configured to engage a detent in each connector, the spring positioned to engage both connectors between the first and second end of each connector, wherein the spring urges both connectors against the movable contact arm and the trip unit stab and establishes an electrical and mechanical coupling.

2. The plug-in trip unit joint of claim 1, wherein each end of the connector includes a spherical surface for engagement with the movable contact arm and the trip unit stab.

3. The plug-in trip unit joint of claim 1, wherein one of the movable contact arm and the trip unit stab includes a spherical surface for engagement with each connector.

4. The plug-in trip unit joint of claim 1, further comprising a pivot pin slidingly mounted in a slot in the movable contact arm and in a pivot aperture in the first end of each connector, with the pivot pin secured in the crossbar of the operating mechanism.

5. The plug-in trip unit joint of claim 4, wherein the pivot pin and the crossbar are aligned on a common axis.

6. The plug-in trip unit joint of claim 5, wherein the pivot pin is secured in the crossbar by a stop on the second end of each connector, with the stop pushing against the first housing of the molded case circuit breaker.

7. A molded case circuit breaker comprising:

a first molded housing including a breaker cover;

a first terminal mounted in the first housing;

a contact electrically coupled to the first terminal;

a second molded housing including a second breaker cover;

an operating mechanism, mounted in the first housing, having a pivoting member movable between an ON position, an OFF position and a TRIPPED position and a movable contact arm coupled to the operating mechanism;

an intermediate latching mechanism mounted in the first housing and coupled to the operating mechanism;

a trip mechanism, mounted in the second housing; and, a plug-in trip unit joint comprising:

a trip unit stab coupled to the trip unit and load terminal and extending from the second housing; and, a movable contact arm clamp assembly mounted in the first housing and aligned to selectively engage the trip unit stab, movable contact arm clamp assembly comprises:

a pair of connectors with one connector Positioned along side of the movable contact arm and one connector positioned on a corresponding opposite side of the movable contact arm, with each connector having a first end and a second end, with the first end configured to engage one side of the movable contact arm and the second end configured to engage one side of the trip unit stab; and, a U-shaped spring, having a lance in each leg, with the lance configured to engage a detent in each connector, spring positioned to engage both connectors between the first and second end of each connector, wherein the spring urges both connectors against the movable contact arm and the trip unit stab and establishes an electrical and mechanical coupling.

8. The plug-in trip unit joint of claim 7, wherein each end of the connector includes a spherical surface for engagement with the movable contact arm and the trip unit stab.

9. The plug-in trip unit joint of claim 7, wherein one of the movable contact arm and the trip unit stab includes a spherical surface for engagement with each connector.

10. The plug-in trip unit joint of claim 7, further comprising a pivot pin slidingly mounted in a slot in the movable contact arm and in a pivot aperture in the first end of each connector, with the pivot pin secured in the crossbar of the operating mechanism.

11. The plug-in trip unit joint of claim 10, wherein the pivot pin and the crossbar are aligned on a common axis.

12. The plug-in trip unit joint of claim 11, wherein the pivot pin is secured in the crossbar by a stop on the second end of each connector, with the stop pushing against the first housing of the molded case circuit breaker.

13. The molded case circuit breaker of claim 7, further comprising:

an accessory socket formed in the breaker cover on either side of an opening for the pivoting member, with the accessory socket in communication with the housing and configured to accept a plurality of different types of accessories; and, an accessory cover sized to cover an accessory mounted in the accessory socket.

* * * * *